United States Patent [19]

Rutenbeck

[11] 4,093,182

[45] June 6, 1978

[54] VEHICLE JACK

[75] Inventor: Hugo Rutenbeck, Breckerfeld, Germany

[73] Assignee: Firma August Bilstein, Ennepetal, Germany

[21] Appl. No.: 799,763

[22] Filed: May 23, 1977

[30] Foreign Application Priority Data

Jun. 4, 1976 Germany ..... 2625085

[51] Int. Cl.[2] ..... B66F 3/12

[52] U.S. Cl. ..... 254/126

[58] Field of Search ..... 254/DIG. 1, 124, 126

[56] References Cited

U.S. PATENT DOCUMENTS 3,989,225 11/1976 Keilholz ..... 254/126

*Primary Examiner*—Robert C. Watson

*Attorney, Agent, or Firm*—Karl F. Ross

[57] ABSTRACT

A vehicle jack in which a push rod is displaced during the later portions of the operation of the actuating member to tilt the support leg and bring into play an additional support surface for stabilizing purposes. The actuating member raises a lifting arm pivotally connected to the support leg and can be a threaded spindle.

15 Claims, 7 Drawing Figures

Figure 1:
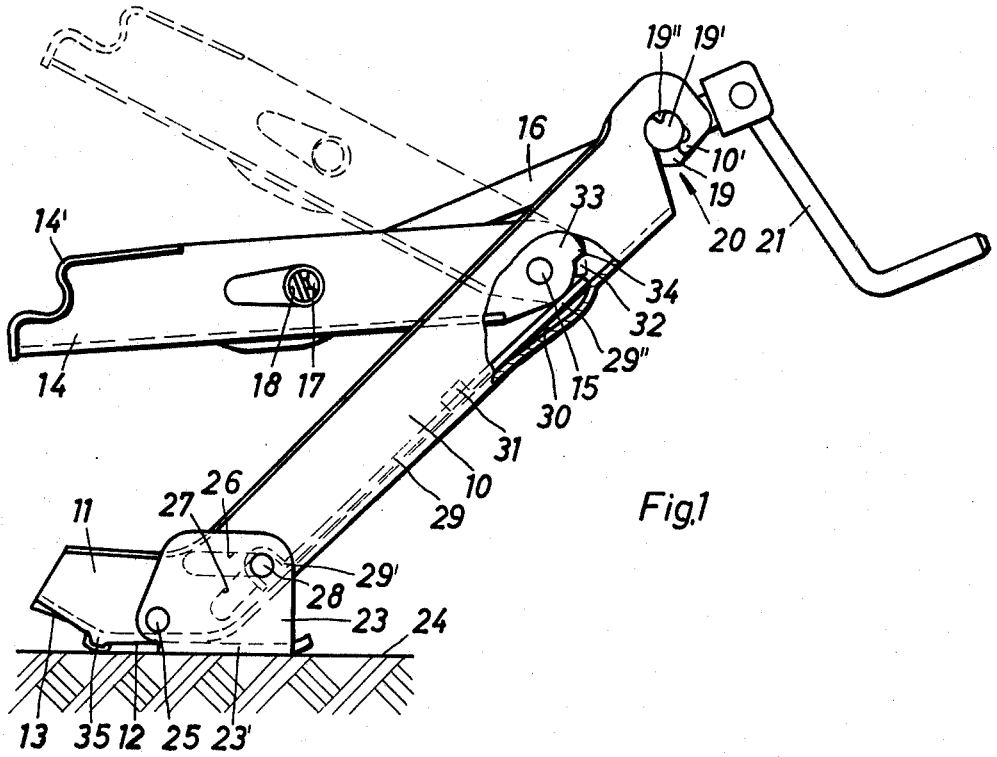

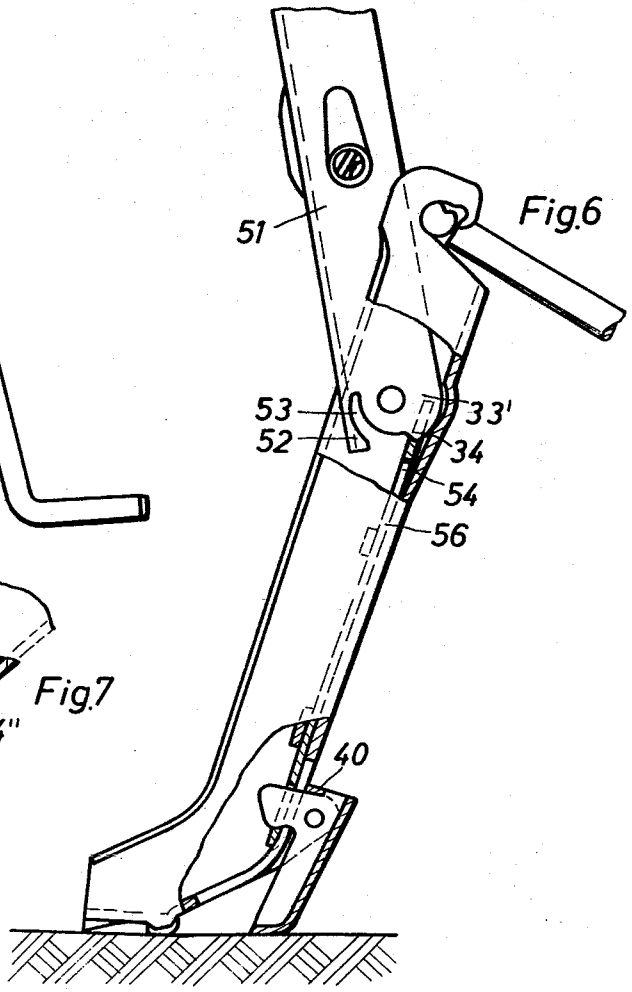
Fig.6
51
53
52
33'
34
54
56
40
Fig.7
15
57
34''
29
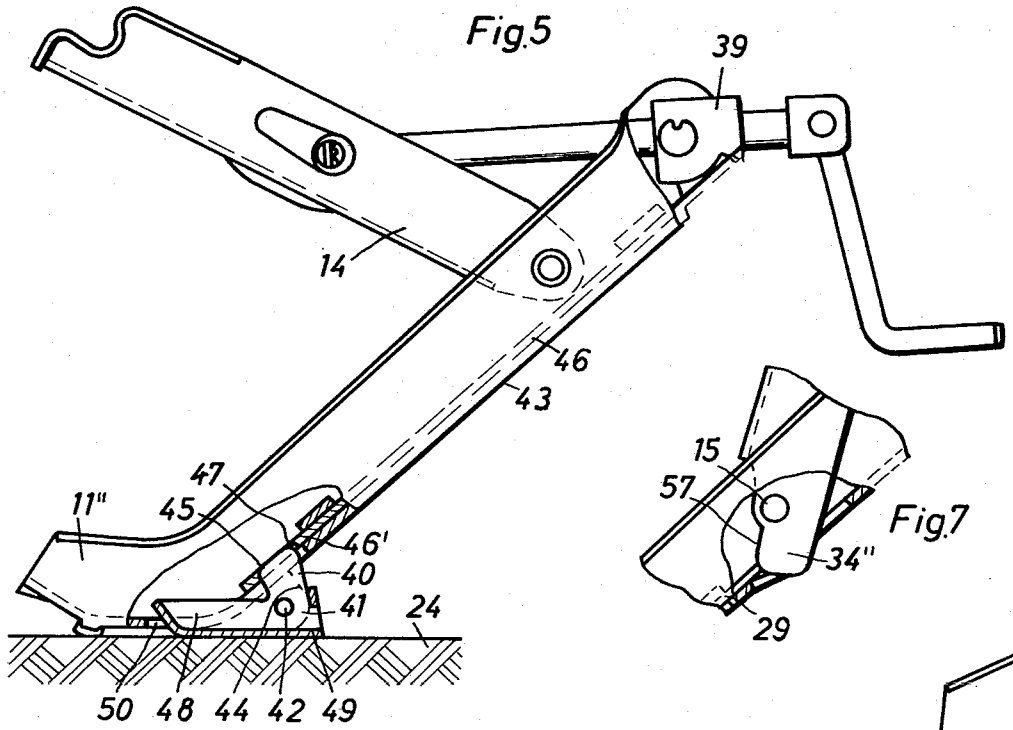
Fig.5
39
14
46
43
46'
40
41
24
49
42
44
48
50
47
45
11''

VEHICLE JACK

FIELD OF THE INVENTION

The invention relates to a vehicle jack having a support leg with a bearer foot, a manually operable adjusting member, in particular a screw spindle, coupled to the support leg, a lifting arm capable of being raised and lowered by the adjusting member and having at its free end a support head engaging the vehicle frame, and an auxiliary foot support movably carried upon the support leg.

BACKGROUND OF THE INVENTION

A known vehicle jack of this type has a support foot which is arranged to swing out upon positioning the jack relative to the vehicle. This support foot ensures that the vehicle jack can be erected with its support leg in the correctly inclined position for raising the power-driven vehicle. This erection with the correctly inclined position of the support leg is necessary to prevent the vehicle jack from slipping out and from damaging the vehicle chassis by the extending action of the vehicle jack which takes place in the lifting operation.

These vehicle jacks are capable of improvement. It has been demonstrated that the stability of the vehicle jack when the vehicle has been lifted still leaves something to be desired.

If the vehicle jack is set up at the side of the vehicle, the vehicle jack can tip over if the center of gravity of the vehicle is so placed and if the forces imposed by the vehicle upon the jack are so directed as together to contribute to this result. In this case the known support foot is unsatisfactory because it loses contact with the support surface in consequence of the erecting action of the support leg.

OBJECT OF THE INVENTION

An object of the invention is an improvement of the vehicle jack of the first described type such that when the vehicle is in the raised position the foot forms a second point of support for increasing the stability of the loaded vehicle jack.

SUMMARY OF THE INVENTION

This object is achieved in that there is provided a coupling member arranged to act upon the foot as well as upon the adjusting member or a lifting component driven by the adjusting member, which coupling member, upon the raising of the lifting arm, brings into effect the additional support by the foot and prevents inadvertent release of the jack.

It is of importance for the invention that the foot support is effective when the vehicle has been lifted. The prescribed condition of the foot is achieved by the coupling member, which controls the foot in dependence upon the lifting stroke of the lifting arm.

A vehicle jack having a lifting arm pivotable about a point upon the vertical axis of the support leg, and having a screw spindle, one end of which is coupled to the lifting arm and the other end of which is suspended by means of a spindle nut to the upper end of the support leg, the bearer foot of which vehicle jack is in the form of a fixed non-hinged rounded foot, is characterized by the feature that the coupling member is a projection, which is arranged upon that end of the lifting arm adjacent the support leg or upon the spindle nut, and which is in adjusting engagement with the foot. This construction of the coupling member in a vehicle jack having a pivoted lifting arm ensures the stability of the jack in a particularly simple and effective manner. In this construction the movement of the foot is directly controlled by the lifting arm and the spindle nut. At the same time the protection of the foot against inadvertent release is achieved in a particularly simple manner. Moreover it is of special importance that the action of the foot can become effective not only in a particular single position of the stroke of the lifting arm, but throughout a selected range of the stroke. This is important because the effective length of stroke of the vehicle jack, for example the length of stroke after positioning the jack relative to the vehicle, is of varying length, for example depending upon whether a greater or less degree of lift is required when changing a wheel.

It is also of importance that the adjustable engagement between the coupling member and the foot shall have lost motion. It is in fact not necessary that the vehicle jack shall already be in the safety condition if the lifting arm is still in a region between the starting position and the vehicle chassis A structurally simple design of the vehicle jack is also achieved by confining the control of the foot to a portion of the range of free movement of the lifting arm, or to the loading range of the lifting arm in which the vehicle is lifted.

According to a further feature of the invention, in addition to the coupling member, a carrier member is provided upon the lifting arm or upon the spindle nut, and is arranged to engage in a return aperture of a push rod when the lifting arm is in the collapsed condition. In the case of a lifting arm of U shaped cross section, the carrier may advantageously be in the form of slots provided in the side flanges of the lifting arm in the vicinity of the back portion of the lifting arm, this arrangement permitting simple resetting of the foot into its initial position. By the adoption of a suitable design of the slots, the foot can be clamped tightly and vibration-free in its initial position.

According to a further feature of the invention there is provided upon the support leg a pivotally mounted foot strut, which is coupled to the lower end of the push rod. This foot strut not only increases the size of the stable support surface, but also makes possible a simplification of the control action in the region of the lifting arm and of the spindle nut, because it is basically possible, by suitable design of the coupling of the pivotably movable foot strut to the support leg and to the push rod, to achieve a step-up or a step-down transmission ratio. For putting into practice this feature of the invention, there are provided both in the support leg and in the foot strut guide slots for controlling the pivoting movement of the foot strut, said slots being traversed by a sliding pin coupled to the push rod. According to a further practical arrangement the foot strut is of L shape and is mounted to the support leg with the apex of the L section external to the support leg, while one of the L limbs of the foot strut is in coupling engagement with the push rod.

Apart from providing stabilized support for the vehicle jack when the vehicle is in the fully lifted position, it is also possible to design the foot strut so that it increases the available ground abutment surface for the vehicle jack.

Figure 2:
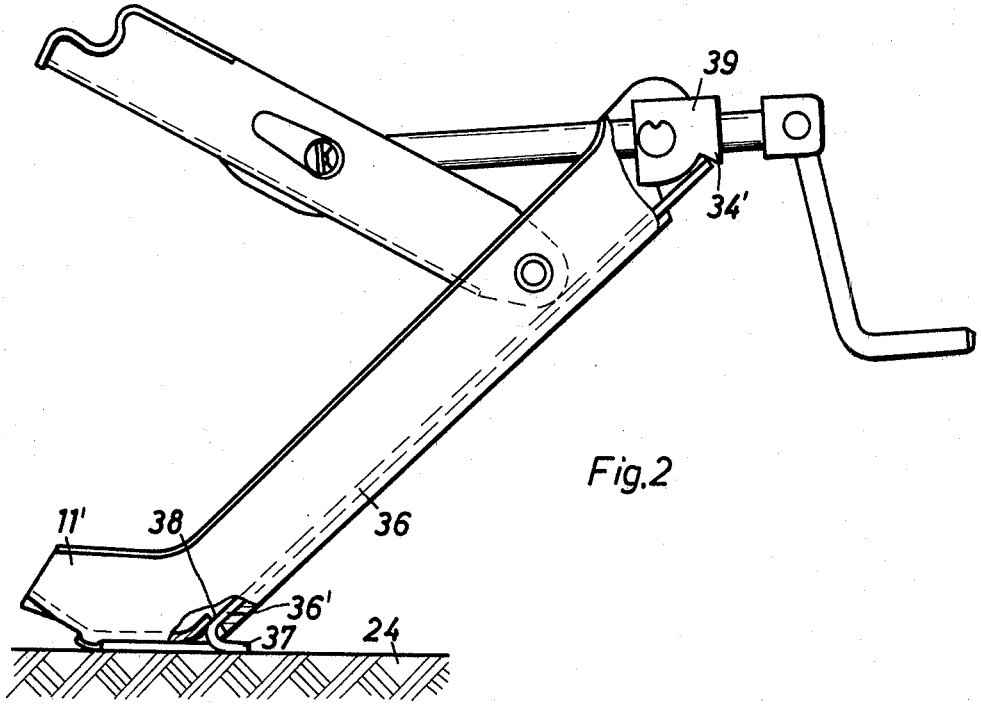
Figure 3:
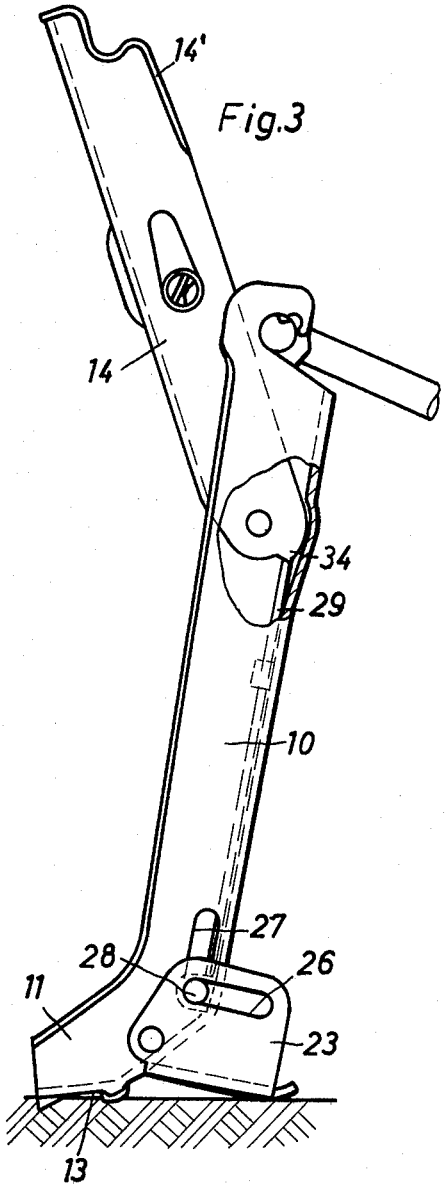
Figure 4:
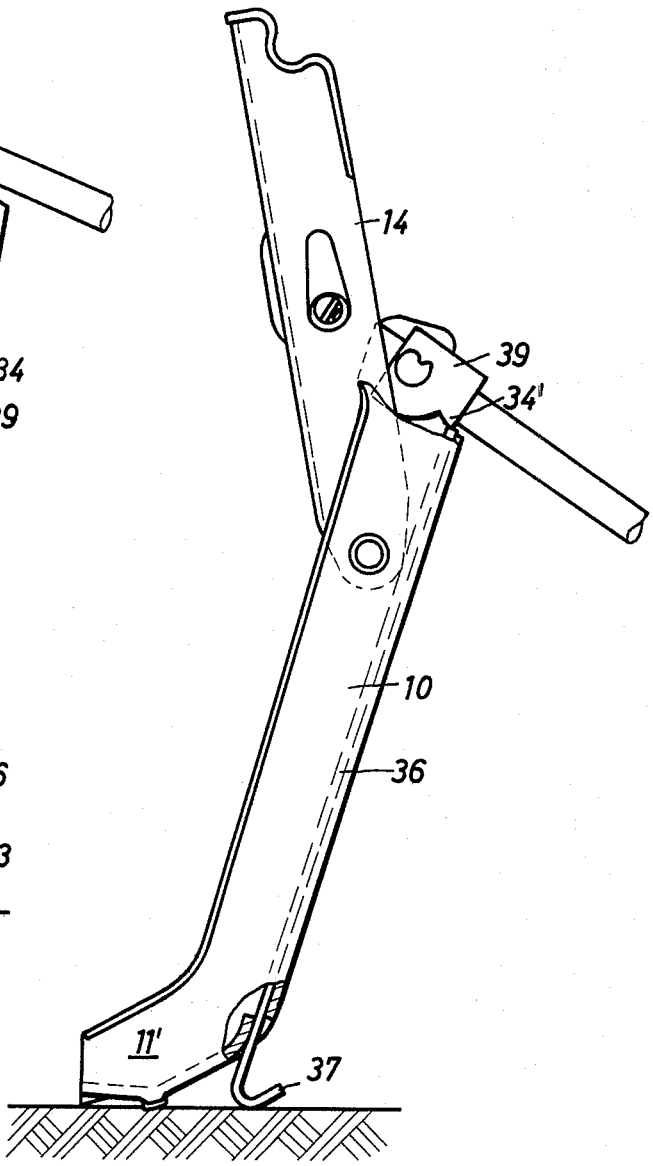

The invention will now be more particularly described with reference to practical examples shown in the accompanying drawing, in which:

FIG. 1 shows a first practical embodiment of the invention having a coupling member mounted on the lifting arm and a hinged foot strut, FIG. 2 shows a second practical embodiment of the invention having a coupling member arranged to cooperate with the spindle nut and wherein the foot strut is not arranged for hinging movement, FIG. 3 shows the vehicle jack according to FIG. 1 with the lifting arm at the fullest extent of its lifting stroke, FIG. 4 shows the vehicle jack according to FIG. 2 with the lifting arm in the fullest extent of its lifting stroke, FIG. 5 shows a third practical embodiment of the invention with a coupling member arranged to cooperate with the spindle nut and having a hinged bearer foot modified as compared with the practical embodiment according to FIG. 1, FIG. 6 shows a fourth practical embodiment in the fully extended position of the lifting arm, and having a hinged bearer foot according to FIG. 5 and a coupling member according to FIG. 1, and FIG. 7 shows a detail at the end of the lifting arm.

SPECIFIC DESCRIPTION

The vehicle jack shown in FIG. 1 has a support leg 10, at the lower end of which is a bearer foot 11 having a setting-up surface 12 and a stable position surface 13. The support leg and the bearer foot are of U shaped cross section, the free longitudinal edges being outwardly flanged to provide strength.

The lifting arm 14, which is also U shaped cross section, is hinged to the support leg 10 for movement about the hinge axis 15. The lifting arm 14 is engaged approximately at its centre by the screw spindle 16, which at this point is rotatable with respect to the lifting arm but axially non-displaceable. For this purpose a ball bearing is provided, a bearing ring of which engages with a bearing pin 17 in suitable apertures 18 in the lifting arm.

The upper end of the screw spindle 16 is mounted in a spindle nut 19 having pins 19' engaging in slots 20 at the upper end of the lifting arm. The pins 19' and the slot 20 are so shaped that the pins, by means of the notches 19'' can be threaded in over a hook 10' of the support leg, from which they are afterwards prevented from slipping out because the pins have their notches 19'' out of coincidence with the hook 10' when the vehicle jack is in the assembled condition.

To the upper end of the screw spindle there is coupled a handcrank 21 whereby the screw spindle can be rotated. FIG. 1 shows that by rotation of the screw spindle 16 the lifting arm 14 can be moved out of the position shown in full lines, for example, into the position shown in dashed lines. This movement corresponds substantially to the beginning of the lifting stroke for raising the vehicle. FIG. 3 shows the vehicle jack in the fully erected position. From the position shown in FIG. 1 the support leg 10 has been raised out of the inclined position shown in FIG. 1 to an almost vertical position, wherein the load bearing point of the lifting head 14' of the lifting arm 14 is still positioned vertically above the load reaction point of the bearer foot 11, but in any case still within the range of the friction cone determined by the load reaction point.

In FIG. 1 there is provided upon the bearer foot a foot strut 23, which is likewise of U cross section and which has its U flanges outwardly embracing the support leg 10. The back web 23' of the foot strut 23 bears against the roadway support surface 24 for the vehicle jack and supplements the setting-up surface 12. The foot strut 23 is movably hinged about the pivot point 25 and is provided in each of its flanges with a sliding pin slot 26. In the support leg 10 there are also provided sliding pin slots 27. The slots 26, 27 are penetrated by a sliding pin 28, which is situated in the common overlapping region of the slots.

The sliding pin 28 is embraced by the lower end 29' of a push rod 29, which is slidably displaceable lengthwise upon the inner surface 30 of the web of the support leg and is retained in position by a clip 31. The upper end 29'' of the push rod 29 terminates within the region of movement 32 of the coupling member 34 carried at the end 33 of the lifting arm.

If the lifting arm 14 is pivoted upwardly, then the coupling member, which is designed in the form of a projection, moves downwardly in a circular path to engage the upper end 29'' of the push rod and forces the latter downwardly. Consequently the foot strut 23 is pivoted until it assumes the position according to FIG. 3 in which the support leg 10 is fully erected. The setting-up action of the foot strut 23 is thereby so controlled that the fulcrum edge 35 of the foot itself and the lowest point of the foot strut 23 both lie in a plane coincident with the road support surface 24.

Lost motion is available between the upper end 29'' of the push rod and the coupling member 34 so that the coupling member presses against the push rod only when the lifting arm 14 has reached a certain height. Consequently, the effect upon the push rod only begins as from that point, which suffices for the purpose because the lifting of the vehicle also begins from that position.

In FIG. 2 there is shown a simplified construction of the foot, wherein the push rod 36 has a bent portion 37 at its lower end, which bears upon the roadway support surface 24. The lower end of the push rod is guided in a slot 38 in the foot 11. Contrasted with the construction of FIG. 1, the push rod 36 is acted upon by a coupling member 34', which is in the form of a projection (cam) mounted upon the spindle nut 39. FIG. 4 shows that the spindle nut 39, which pivots together with the screw spindle 16, is in a position to exercise the desired control over the push rod 36 by means of the projection 34'. It is also possible that any component which is acted upon by the screw spindle 16, or by any similarly functioning adjusting member, is also in a position to exercise control over a push rod or a foot, provided that said component is in a position to perform the necessary adjusting movement.

In FIG. 5 there is shown a L shaped foot strut 40, which is mounted so that its apex 41 is pivotally movable about the pivot axis 42. The ends of the pivot pin 42 engage in lugs 44 connected to the back web 43 of the support leg and shown in the drawing in dashed lines. The angled limb 45 of the foot strut is in coupling engagement with the push rod 46, which is provided for this purpose with an aperture 47 embracing the offset limb 45. The other limb 48 of the angled foot strut is suitably dimensioned to provide the necessary supporting length and is provided with a support flange 49 to afford an improved bearing surface upon the roadway surface 24. In the setting-up position of the vehicle jack, the limb 48 engages in a slot 50 in the support surface of the foot 11''.

Upon operating the push rod 46 by the spindle nut 39, the limb 48 of the foot strut 40 is outwardly pivoted and assumes the position shown in FIG. 6.

FIG. 6 shows a carrier 52 at the end 33' of the lifting arm 51 adjacent the support leg, this carrier being formed by making slots 53 in the side flanges of the U shaped lifting arm adjacent the back web of the lifting arm. The slots 53 are of substantially circular form. They engage in a return aperture 54 of the push rod 56 when the lifting arm 51 has substantially reached the position shown in FIG. 5. If the lifting arm 51 is lowered further from such position, then the carrier 52 draws the push rod 56 upwardly and thereby moves the foot strut 40 into the position shown in FIG. 5. It is also possible to perform such a resetting motion by means of a return spring operating between the push rod and the support leg, which, nevertheless, would entail additional expenditure for the construction.

According to FIG. 7 the control of the push rod 29 is effected by means of a coupling member 34'', which is provided with a projecting control cam member 57, by means of which it is possible to achieve a control of the push rod better suited to the requirements, because of the different spacing distances between the individual points of the cam and the pivoting axis 15. The back web of the support leg is provided with a suitable cavity to receive the cam.

The push rod 36 is provided at its lower end with a stop, not shown in the drawing, for limiting the length of its advance, so that it cannot fall out of the slots 38.

I claim:

1. In a vehicle jack having a support leg with a bearer foot, a manually operable adjusting member, in particular a screw spindle, coupled to the support leg, a lifting arm capable of being raised and lowered by the adjusting member and having at its free end a support head engaging the vehicle frame, and an auxiliary foot movably carried upon the support leg, the improvement which comprises a coupling member arranged to act upon the auxiliary foot and operatively displace upon operation of said adjusting member, which coupling member, upon the raising of the lifting arm brings into effect an additional support provided by the auxiliary foot and prevents inadvertent release of the jack.

2. The improvement defined in claim 1, wherein said lifting arm is pivotable about a point upon the vertical axis of the support leg, and having a screw spindle one end of which is coupled to the lifting arm and the other end of which is suspended by means of a spindle nut to the upper end of the support leg, the bearer foot being in the form of a fixed non-hinged rounded portion of said support leg, and wherein the coupling member is a projection arranged on that end of the lifting arm which is adjacent the support leg, or upon the spindle nut and which is in adjusting engagement with the auxiliary foot.

3. The improvement defined in claim 1 wherein there is lost motion in the adjusting engagement between the coupling member and the auxiliary foot.

4. The improvement defined in claim 1 wherein the auxiliary foot has a push rod arranged in the support leg, the upper end of the push rod being disposed within the range of movement of the coupling member.

5. The improvement defined in claim 1 wherein upon the lifting arm or upon the spindle nut there is provided a carrier, which engages in a resetting aperture of the push rod when the lifting arm is an a lowered position.

6. The improvement defined in claim 1 wherein the lifting arm is of U shape cross section, the carrier being formed by slots in side flanges of the lifting arm situated adjacent the back web of the lifting arm.

7. The improvement defined in claim 4 wherein the lower end of the push rod is guided through a slot of the bearer foot and directly abuts upon the roadway support surface for the vehicle jack to form said auxiliary foot.

8. The improvement defined in claim 14 wherein upon the support leg there is provided a pivotable movable foot strut formed with said auxiliary foot and which is pivoted to the lower end of the push rod.

9. The improvement defined in claim 8 where in there are provided both in the support leg and in the foot strut respective sliding pin slots for controlling the pivoting movements between the support leg and the foot strut, said slots being penetrated by a pin coupled to the push rod.

10. The improvement defined in claim 8 wherein the foot strut is of U shaped cross section and outwardly embraces the support leg.

11. The improvement defined in claim 8 wherein the foot strut is of L shape and is mounted upon the support leg with the apex of the foot strut positioned externally of the support leg, one of the limbs of the L shaped foot strut being in coupling engagement with the push rod.

12. The improvement defined in claim 8 wherein the foot strut is arranged to supplement an already available support surface provided by the bearer foot of the vehicle jack.

13. The improvement defined in claim 3 wherein the coupling member has a control cam for the push rod.

14. The improvement defined in claim 3, further comprising a resetting spring operating between the support leg and the push rod.

15. The improvement defined in claim 3 wherein the push rod is provided with a stop for limiting its advancing movement.

* * * * *